United States Patent [19]

Woods

[11] 4,338,754

[45] Jul. 13, 1982

[54] PANELLING EDGING

[75] Inventor: David C. Woods, Quakertown, Pa.

[73] Assignee: Burlington Industries, Inc., Greensboro, N.C.

[21] Appl. No.: 153,132

[22] Filed: May 27, 1980

[51] Int. Cl.[3] ..... E04B 1/38

[52] U.S. Cl. ..... 52/393; 52/582; 52/716

[58] Field of Search ..... D25/73, 74, 75; 49/490, 49/501; 52/399, 403, 716, 823, 393, 582; 428/57, 83, 122, 358; 156/60, 71

[56] References Cited

U.S. PATENT DOCUMENTS

| | | | |
|---|---|---|---|
| 3,729,889 | 5/1973 | Baruzzini | 52/403 X |
| 4,045,927 | 9/1977 | Diaz | 52/403 X |
| 4,128,983 | 12/1978 | Mastsubara | 52/403 X |
| 4,154,036 | 5/1979 | Moss et al. | 52/403 X |

*Primary Examiner*—Henry F. Epstein

*Attorney, Agent, or Firm*—Cushman, Darby & Cushman

[57] ABSTRACT

An edge structure for use with a room dividing panel is provided, as well as room dividing panels utilizing the edge structure, and a method of manufacture and/or utilization of such panels. The edge structure includes a unitary extrusion, elongated in a first dimension, of flexible plastic material. The extrusion includes a hollow anchoring portion adapted to anchor the extrusion in a channel in the room dividing panel, and elongated in a second dimension transverse to the first dimension; a pair of support portions extending outwardly from and on opposite sides of the anchoring portion and adapted to engage and overlap an edge of the room dividing panel; and a pair of flexible lips. Each of the lips has one end thereof integral with a support portion, extends toward the other of the support portions, and terminates in a free end unconnected to any other structures. The free ends of the lips are spaced from each other in a third dimension perpendicular to both the first and second dimensions, and are spaced from the support portions in the second dimension. At least one panel interlocking hardware pin is received by the anchoring portion when disposed in the panel channel, the panel extending in the third dimension, and two adjacent panels are interlocked together by a panel hardware structure extending between aligned pins of adjacent panels. The free ends of the lips of the adjacent panels are moved in the second dimension and provide a light-tight interface along the edges between panels. The faces of the panels forming the interface are in-line and flush without any intervening ridge.

8 Claims, 3 Drawing Figures

PANELLING EDGING

BACKGROUND AND SUMMARY OF THE INVENTION

In the construction of room dividers utilizing room dividing panels, it is highly desirable to be able to provide such panels with light-tight interfaces between adjacent panels, and an acoustic barrier between the panels. Various techniques have been proposed in the prior art for providing light-tight interfaces between panels. While many of such prior proposals have been relatively successful, there often are drawbacks associated therewith. For instance oftentimes the sealing structure is external and visible. Some proposed constructions have male and female components which complicate assembly and manufacture problems, and others require the addition of accessory elements in order to effect the sealing function.

According to the present invention an edge structure for a room dividing panel, and a room dividing panel combination and method of manufacture and utilization thereof, are provided that overcome most of the drawbacks inherent in prior art proposals. According to the present invention a simple room dividing panel edge structure is provided which is formed from a single extrusion requiring virtually no assembly labor to put into use. All panels to be assembled with the edge structures according to the invention have identical components, no male or female components being provided. The panels may be assembled together so that they are flush, with no external or protruding components, and there are no loose parts or accessory elements that must be added by the assembler. In general, the structure and method according to the present invention provides for the assembly of room dividing panels together so that a light-tight and acoustic barrier interface is provided therebetween, yet the panels present a clean, aesthetic appearance, and can be manufactured and assembled in a simple and inexpensive manner.

According to one aspect of the present invention, an edge structure for use with a room dividing panel for providing a light-tight interface between adjacent panels is provided. The structure includes a unitary extrusion, elongated in a first dimension, of flexible material and comprising three basic components. The first component is a hollow anchoring portion adapted to anchor the extrusion in a channel in a room dividing panel, the anchoring portion also elongated in a second dimension transverse to the first dimension. The second component comprises a pair of support portions extending outwardly from and on opposite sides of the anchoring portion, and adapted to engage and overlap an edge of a room dividing panel. The third component comprises a pair of flexible lips, each lip having one end thereof remote from a support portion and a section thereof remote from the anchoring portion, and extending toward the other of the support portions, and terminating in a free end unconnected to any other structures. The free ends of the lips are spaced from each other in a third dimension perpendicular to both the first and second dimensions, and are spaced from support portions in the second dimension. The hollow anchoring portion comprises first and second side sections with a bottom section joining the side sections, and the side sections being unconnected opposite the bottom section. A plurality of cooperating openings are provided in the anchoring portion side sections, the openings extending in said third dimension, and for receipt of one or more pins of panel interlocking hardware.

According to another aspect of the present invention, a room dividing panel is provided. The room dividing panel comprises a body portion including an edge elongated in a first dimension, with means defining a channel in the edge extending in a second dimension perpendicular to the first dimension, and extending along the edge in the first dimension. An edge structure is provided for cooperating with the edge to provide a light-tight engagement between the edge and a cooperating edge of an adjacent panel. The edge structure comprises a unitary extrusion, elongated in the first dimension, of flexible material (a plastice). The edge structure comprises a hollow anchoring portion elongated in the second dimension and disposed within the panel edge channel; a pair of support portions extending outwardly from and on opposite sides of the anchoring portion, and engaging and overlapping the panel edge; and a pair of flexible lips, each lip having one end thereof integral with a support portion at a section thereof remote from the anchoring portion and extending toward the other of the support portions and terminating in a free end unconnected to any other structures. At least one panel interlocking hardware pin is disposed in the channel, extending in a third dimension perpendicular to both the first and second dimensions, and supported at least in part by the extrusion hollow anchoring portion. The room dividing panel may be provided in combination with a second, substantially identical panel. At least one panel interlocking hardware latching structure extends between aligned pins of the panels disposed in the respective channels, and holds the panels together so that the free ends of the flexible lips of both panels are moved in the second dimension and the lips are pressed together in light-tight sealing relationship.

According to another aspect of the present invention a room dividing panel combination is provided which comprises a pair of panels. Each panel comprises a body portion including an edge elongated in a first dimension with means defining a channel in the edge extending in the second dimension perpendicular to the first dimension, and a pair of side faces; at least one panel interlocking hardware pin disposed in the channel and extending in the third dimension perpendicular to both the first and second dimensions; and an edge structure. The edge structure is elongated in the first dimension and disposed in the channel and extends outwardly therefrom in the second dimension, and covers and overlaps the panel in the third dimension. The edge structure comprises means for providing a unitary integral structure that cooperates with the like edge structure of the other of the pair of panels to deform in the second dimension and provide a light-tight interface between the panels with the panel side faces in-line and flush and without an intervening ridge along the in-line side faces thereof. At least one panel interlocking hardware structure extends between aligned pins of the panels and effects interlocking of the panels together with the edge structure thereof deformed in the second dimension to provide a light-tight interface therebetween.

The invention also contemplates a method of constructing a room dividing panel. A panel body portion is formed, including an edge elongated in a first dimension. A channel is formed in the body portion edge, the channel extending in a second dimension perpendicular to the first dimension and extending along the edge in the first dimension. An edge structure is provided by extruding from flexible plastic material a unitary extrusion including a hollow anchoring portion, a pair of support portions, and a pair of flexible lips. At least one panel interlocking pin is disposed into operative association with the edge structure anchoring portions, and then the anchoring portion of the edge structure is affixed in the channel so that the support structures cover and overlap the panel edge and so that the hardware pin extends in a third dimension perpendicular to both the first and second dimensions. According to the present invention a method of utilizing a pair of room dividing panels, constructed as outlined above, is also provided. The method is practiced by disposing the lips of the edge structures of the panels in abutting relationship, and then inserting a panel interlocking hardware structure into operative association with aligned pins of the panels so that the free ends of the flexible lips of both panels are moved in the second dimension and the lips are pressed together in light-tight sealing relationship, with the panels physically, releasably attached together.

It is the primary object of the present invention to provide a simple, effective, and easy to manufacture and use edge structure in combination with a room dividing panel, for providing a light-tight aesthetic interface with adjacent panels, and methods of manufacture and utilization thereof. This and other objects of the invention will become clear from an inspection of the detailed description of the invention, and from the appended claims.

DETAILED DESCRIPTION OF THE DRAWINGS

Figure 1:
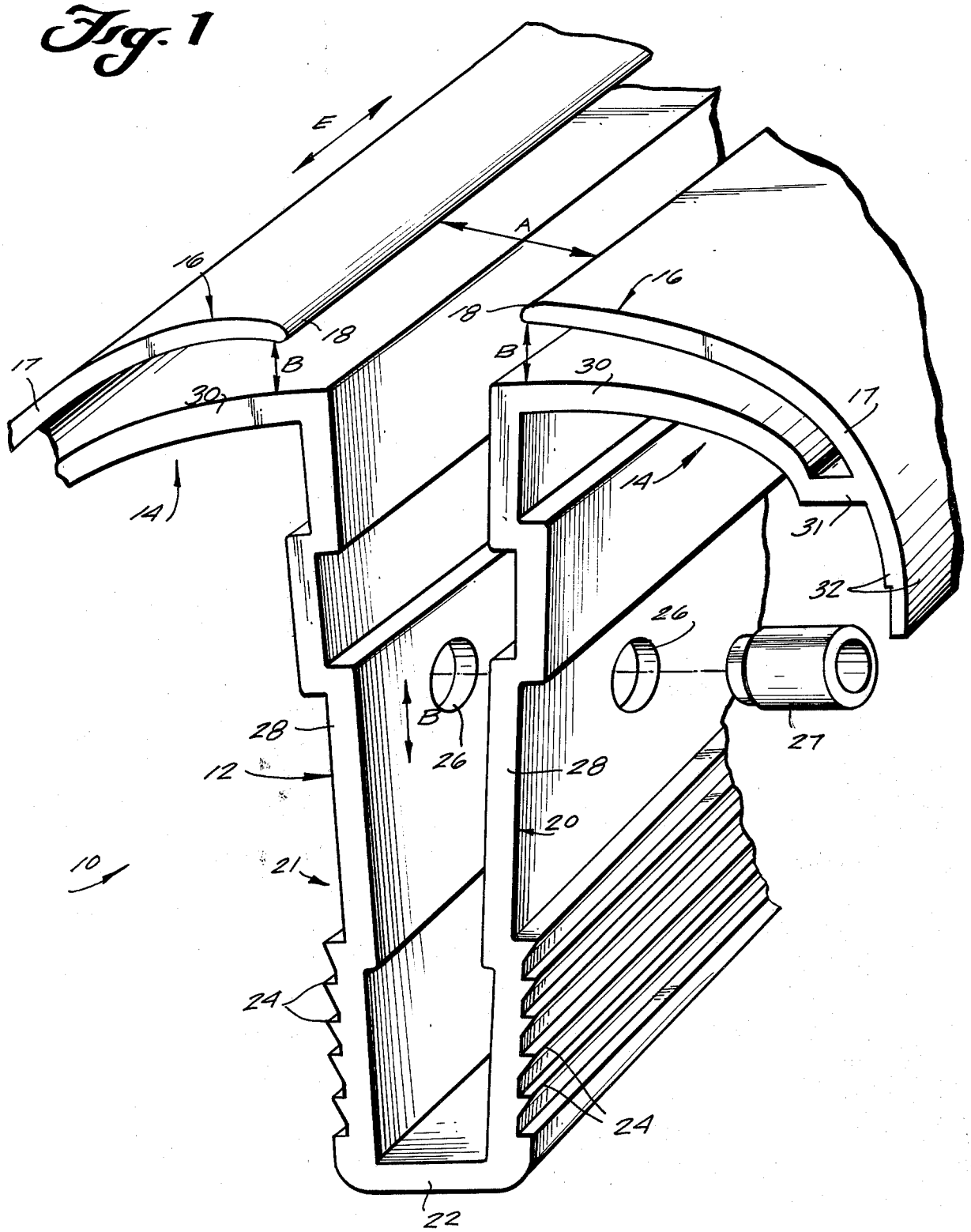
FIG. 1 is a partial perspective view of an exemplary edge structure formed according to the present invention.

An exemplary edge structure for use with a room dividing panel for providing a light-tight interface (and acoustic barrier) between adjacent panels is illustrated generally at 10 in the drawings. The edge structure 10 comprises a unitary extrusion, elongated in a first dimension E (see FIG. 1) of flexible material, preferably a vinyl for durability and washability while performing the desired functions. The extrusion 10 comprises three main components: a hollow anchoring portion 12; a pair of support portions 14 extending outwardly from and on opposite sides of the anchoring portion 12; and a pair of flexible lips 16, each lip having one end 17 thereof integral with the support portion 14 and terminating in a free end 18 unconnected to any other structures.

The hollow anchoring portion 12 comprises first and second side sections 20, 21 respectively, and a bottom section 22 joining the side sections, the side sections 20, 21 being unconnected opposite the bottom section so that the extrusion 10 provides an open channel between the support portions 14 and flexible lips 16 along the entire first dimension E. The anchoring portion 12 is also elongated in a second dimension B. The exterior surfaces of portions of the side sections 20, 21 adjacent the bottom section 22 have projections 24 formed thereon for increasing frictional resistance with a channel in a room dividing panel edge with which they are adapted to cooperate. Means defining a plurality of cooperating openings 26 in the side sections 20, 21 also are provided, the openings extending generally in a third dimension A perpendicular to both the first and second dimensions E, B. Each cooperating set of openings 26 (see the set illustrated in FIG. 1) is for receipt of a steel pin 27 or the like, of panel interlocking hardware, the pin 27 having substantially the same outside diameter as the inside diameter of the openings 26, the side sections 20, 21 at least in part supporting the pin 27 in place for performing an interlocking function. As illustrated in the drawings, the openings 26 are preferably provided in sections 28 of the side sections 20, 21.

Figure 2:
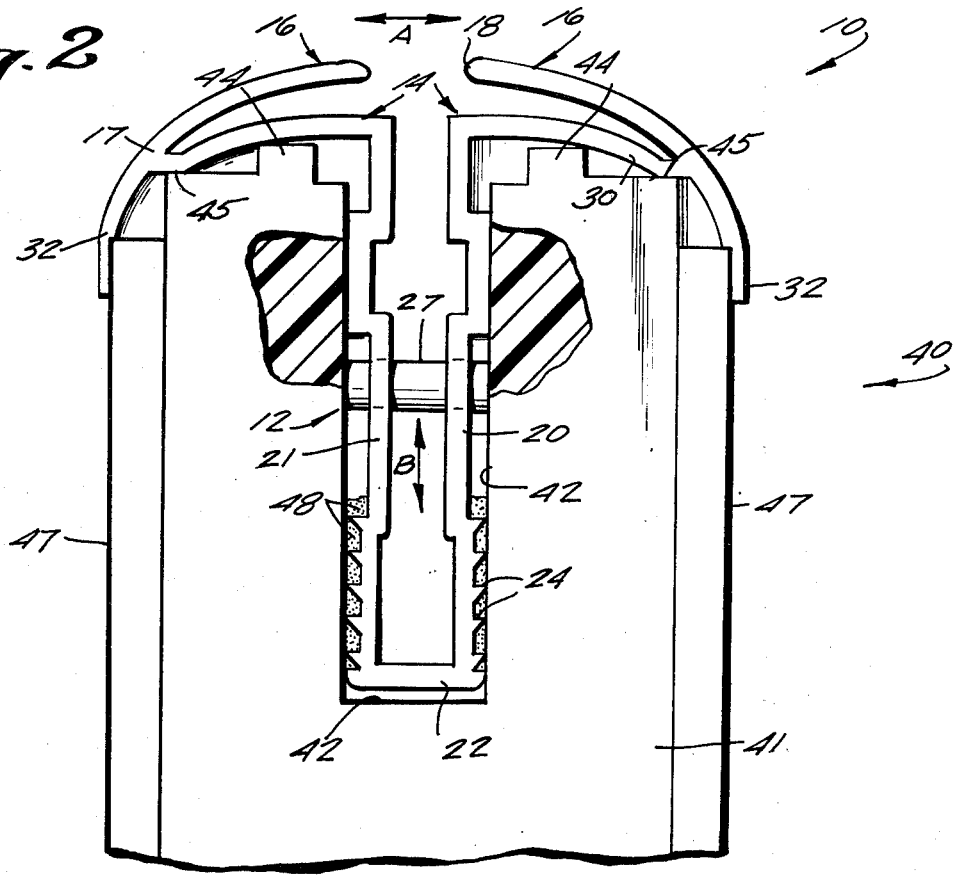
FIG. 2 is a top view, partly in cross-section and partly in elevation, illustrating the edge structure of FIG. 1 in combination with an exemplary room-dividing panel edge.
Figure 3:
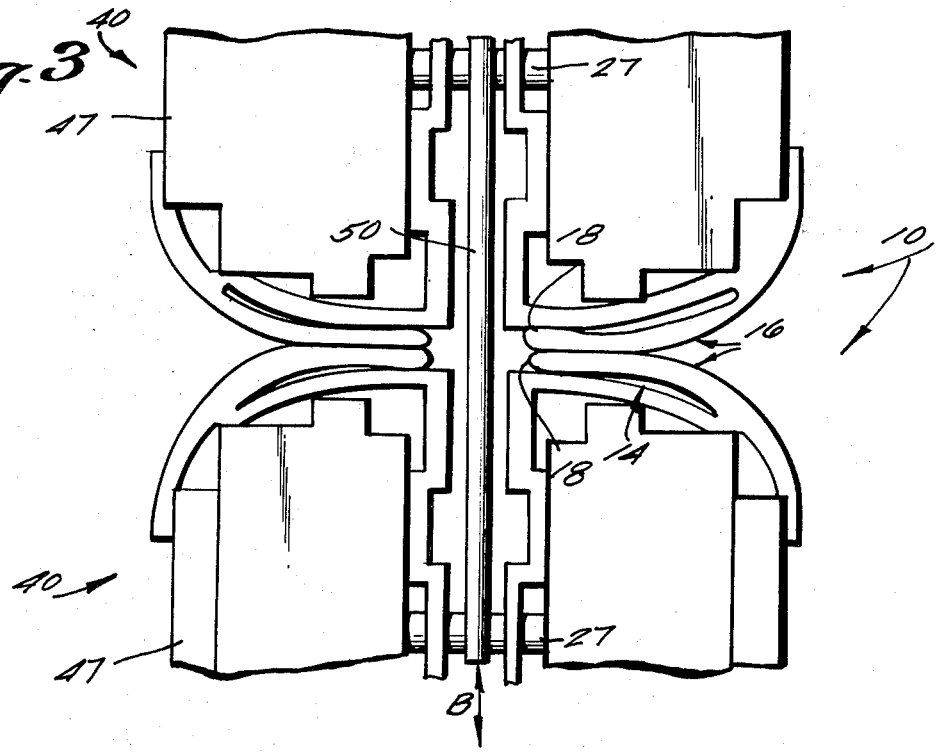
FIG. 3 is a view like that of FIG. 2 only illustrating two adjacent panels held together with a light-tight interface therebetween.

As illustrated in FIG. 1, the side sections 20, 21 are preferably constructed and disposed so that they are movable from a first position—illustrated in FIG. 1—wherein they diverge outwardly from each other from their connection at the bottom section 22 to portions thereof remote from the bottom section, to a second position—illustrated in FIGS. 2 and 3—in which they are adapted to be disposed within a channel in a room dividing panel edge for receipt thereof. In the second position—FIGS. 2 and 3—the side sections 20, 21 are substantially parallel to each other along the lengths thereof. By constructing the extrusion 10 anchoring portion 12 in this manner, an inherent bias is provided for holding the anchoring portion in place within a panel edge channel.

The extrusion 10 support portions 14 extend outwardly from and on opposite sides of the anchoring portion 12, one support portion 14 extending outwardly from each of the side sections 20, 21 of the anchoring portion 12. Each extrusion support portion 14 comprises a first section 30 integral with a side section 20, 21 of the anchoring portion 12 and generally extending in the third dimension A, each first section 30 being arcuate. Each support portion 14 further comprises a second section 31 interconnecting the first section 30 with a flexible lip 16 at a connected end 17 thereof, the second section 31 being basically flat and extending in a third dimension A. Each support portion 14 further comprises a third section 32 extending opposite the flexible lip 16 and providing an overlapping portion for the edge of a room dividing panel with which it is adapted to be utilized, the third section 32 providing an arcuate continuation of the flexible lip 16.

The flexible lips 16, as shown most clearly in FIGS. 1 and 2, are constructed so that the free ends 18 thereof are spaced from each other in the third dimension A (and in fact are spaced from each other a distance greater than the spacings of the support portions 14 in dimension A), and are spaced from the support portions 14 in the second dimension B. In one exemplary construction according to the present invention, the spacing between the flexible lips 16 free ends 18 and the support portions 14 in the second dimension B would be 0.135 inches.

A room dividing panel according to the present invention, utilizing the edge structure 10 of FIG. 1, is shown generally at 40 in FIGS. 2 and 3. Each panel 40 comprises a body portion 41 which includes an edge with means defining a channel 42 in the edge. The edge is elongated in the first dimension E, corresponding to the first dimension of the edge structure 10, which edge structure 10 also extends in the second dimension B. In use of the panel 40, the dimension E will usually be vertical. The panel 40 according to the present invention preferably is a vinyl room dividing panel, although the use of a high pressure laminate on the surface, veneer, or any other hard surface capable of hollow panel on frame construction is utilizable. The edge of the panel body 41 may include various surface manifestations, such as projections 44 and flat portions 45, which are engaged by particular sections of the support portions 14 of the edge structure 10, with the third sections 32 of the edge structure 10 engaging and overlapping the panel edge as illustrated in FIG. 2. The panel 14 also includes, of course, external side faces 47 which define planes extending in dimensions E, B.

An edge structure 10 in cooperation with a panel body portion 40, according to the present invention, is illustrated in FIG. 2, with the projections 24 of the hollow anchoring portion 12 of the extrusion 10 engaging the side walls of the channel 42 in the panel body section 41. Additionally, an adhesive, shown at 48 in FIG. 2, preferably is also provided to hold the anchoring portion 12 in place in channel 42. Adhesive also may be applied to faces 45.

A pair of exemplary panels 40 according to the present invention are shown in light-tight, acoustic barrier, relationship in FIG. 3. As illustrated in FIG. 3, the free ends 18 of the flexible lips 16 of the adjacent panels 40 have moved in the dimension B, flexing about the connected ends 17 thereof, so that the lips 16 of the adjacent panels 40 are pressed together in light-tight sealing relationship, also providing an acoustic barrier. At least one panel interlocking hardware latching structure 50 extends between aligned pins 27 of the adjacent panels 40 to hold the panels 40 together with the lips 16 thereof deformed as illustrated in FIG. 3. The interlocking hardware may be of any conventional type, such as that provided for the commercially available UPS panels sold by J. G. Furniture (a division of Burlington Industries) of Quakertown, Pa.

As illustrated in FIG. 3, according to the present invention a light-tight interface between the panels 40 is provided with the panel side faces 47 in-line and flush and without an intervening ridge along the in-line side faces thereof, providing a clean, aesthetic presentation. While normally the panels 40 will be connected together by the hardware 50 in the manner illustrated in FIG. 3 the adjacent panels 40 also may be connected together at right angles to each other, or at angles between a perpendicular or in-line relationship, by utilizing suitable interlocking hardware in place of the structure 50.

In constructing an exemplary panel 40 according to the present invention the following steps are practiced: Forming a panel body portion 41 including an edge elongated in the first dimension E. Forming a channel 42 in the body portion edge, the channel 42 extending in the second dimension B perpendicular to the first dimension E, and extending along the edge in the first dimension E. Forming an edge structure 10 by extruding it from flexible plastic material (such as vinyl) to provide a unitary extrusion. At least one (preferably a plurality of) steel panel interlocking hardware pins 27 are disposed in operative relationship with the edge structure 10, such as by inserting the pin 27 through a pair of cooperating openings 26 in the anchoring portion 12 of the extrusion 10 (see FIG. 1). Then the side sections 20, 21 of the extrusion 10, which diverge from the bottom interconnection 22 toward the top thereof, are pushed together and the bottom section 22 of the anchoring portion 12 inserted into the channel 42 along substantially the entire length of the channel 42 and extrusion 10. The anchoring portion 12 is affixed in the channel 42 so that the support structures 14 cover and overlap the panel edge and so that the hardware pin 27 extends in the third dimension A, the affixing preferably being practiced utilizing a suitable adhesive 48 in addition to the engaging projections 24 of the anchoring portion 12.

Once a pair of panels have been constructed according to the method described above, they are utilized according to a method comprising the following steps: Disposing the lips 16 of the edge structures of the panels in abutting relationship. Then, inserting a panel interlocking hardware structure 50 into operative association with aligned pins 27 of the panels 40 so that the free ends 18 of the flexible lips 16 of both panels are moved in the second dimension B, the lips 16 being pressed together in light-tight sealing relationship, with the panels physically, releasably attached together (as illustrated in FIG. 3), with the side faces 47 thereof in-line and flush with no intervening ridge.

It will thus be seen that according to the present invention a simple, efficient edge structure for room dividing panels has been provided which provides a light-tight interface between adjacent panels (as well as an acoustic barrier) while presenting a clean, aesthetic appearance. The edge structures according to the present invention are simple to manufacture and utilize, and the room dividing panels according to the present invention which utilize the edge structures also are easy to manufacture and utilize.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A room dividing panel comprising a body portion, said body portion including an edge elongated in a first dimension with means defining a channel in said edge extending in a second dimension perpendicular to said first dimension and extending along said edge in said first dimension;

an edge structure for cooperating with said edge to provide a light-tight engagement between said edge and a cooperating edge of an adjacent panel, said edge structure comprising a unitary extrusion, elongated in said first dimension, of flexible material and comprising: a hollow anchoring portion elongated in said second dimension and disposed within said panel edge channel; a pair of support portions extending outwardly from and on opposite sides of said anchoring portion, and engaging and overlapping said panel edge; a pair of flexible lips, each lip having one end thereof integral with a said support portion at a section thereof remote from said anchoring portion and extending toward the other of said support portions and terminating in a free end unconnected to any other structures; and wherein the free ends of said lips are spaced from each other in a third dimension perpendicular to both said first and second dimensions, and are spaced from said support portions in said second dimension; and wherein said hollow anchoring portion is open along said panel edge; and at least one panel interlocking hardware pin disposed and held in said channel, extending in said third dimension, and supported at least in part by said extrusion hollow anchoring portion.

2. A room dividing panel as recited in claim 1 in combination with a second, substantially identical panel, and further comprising at least one panel interlocking hardware latching structure extending between aligned pairs of said at least one hardware pin disposed in the respective channels of said panels, and holding said panels together so that the free ends of said flexible lips of both panels are moved in said second dimension and said lips are pressed together in light-tight sealing relationship.

3. A room dividing panel as recited in claim 1 wherein each of said extrusion support portions comprises a first section integral with said anchoring portion and generally extending in said third dimension, said first section being arcuate and overlying said panel edge on one side of said channel; a second section interconnecting said first section with said flexible lip, said second section being basically flat and extending in said third dimension; and a third section extending opposite said flexible lip and providing a portion overlapping the edge of said panel, said third section providing an arcuate continuation of said flexible lip.

4. A room dividing panel as recited in claim 3 wherein said hollow anchoring portion comprises a first side section, a second side section, and a bottom section joining said side sections, the side sections being unconnected opposite said bottom section to provide said channel open, and all of said anchoring portion sections having interior and exterior surfaces; and said side sections being substantially parallel to each other and to the walls of said channel receiving same.

5. A room dividing panel as recited in claim 4 wherein portions of the exterior surfaces of said anchoring portion side sections adjacent said bottom section have projections formed thereon for increasing frictional resistance with said channel walls; and further comprising an adhesive disposed between said anchoring portion side portions exterior surfaces and said channel walls to hold said anchoring portion in place in said channel.

6. A room dividing panel as recited in claim 4 wherein said at least one panel interlocking hardware pin is supported by means defining cooperating openings in said anchoring portion side sections, said openings extending in said third dimension, and said pin having ends extending through said openings.

7. A method of utilizing a pair of room dividing panels, each of the panels comprising: a body portion, the body portion including an edge elongated in a first dimension with means defining a channel in the edge extending in a second dimension perpendicular to the first dimension, and extending along the edge in the first dimension; an edge structure for cooperating with the edge to provide a light-tight engagement between the edge and a cooperating edge of an adjacent panel, the edge structure comprising a unitary extrusion, elongated in the first dimension, of flexible material and comprising: a hollow anchoring portion elongated in the second dimension and disposed within the panel edge channel; a pair of support portions extending outwardly from and on opposite sides of the anchoring portion, and engaging and overlapping the panel edge; a pair of flexible lips, each lip having one end thereof integral with a support portion at a section thereof remote from the anchoring portion and extending toward the other of the support portions and terminating in a free end unconnected to any other structures; and wherein the free ends of the lips are spaced from each other in a third dimension perpendicular to both the first and second dimensions, and are spaced from the support portions in the second dimension; and wherein the hollow anchoring portion is open along the panel edge; and at least one panel interlocking hardware pin disposed and held in the channel, extending in the third dimension, and supported at least in part by the extrusion hollow anchoring portion; said method comprising the steps of disposing the lips of the edge structures of the panels in abutting relationship; and inserting a panel interlocking hardware structure into operative association with aligned pins of the panels so that the free ends of the flexible lips of both panels are moved in the second dimension and the lips are pressed together in light-tight sealing relationship, with the panels physically, releasably, attached together.

8. A room dividing panel combination comprising a pair of panels, each comprising:

a body portion, said body portion including an edge elongated in a first dimension with means defining a channel in said edge extending in a second dimension perpendicular to said first dimension, and extending along said edge in said first dimension; and a pair of side faces;

at least one panel interlocking hardware pin disposed in said channel, extending in a third dimension perpendicular to both said first and second dimensions;

an edge structure elongated in said first dimension and disposed in said channel and extending outwardly therefrom in said second dimension, and covering and overlapping said panel in said third dimension, said edge structure comprising means for providing a unitary integral structure that cooperates with a like edge structure of the other of said pair of panels to deform in said second dimension and provide a light-tight interface between the panels with the panel side faces in-line and flush and without an intervening ridge along the in-line side faces thereof; and wherein the combination further comprises at least one panel interlocking hardware structure extending between aligned pins of said panels and effecting interlocking of the panels together with the edge structures thereof deformed in said second dimension to provide a light-tight interface therebetween.

* * * * *